US007018246B2

(12) United States Patent
Raistrick et al.

(10) Patent No.: US 7,018,246 B2
(45) Date of Patent: Mar. 28, 2006

(54) MAINTENANCE OF UNIFORM IMPEDANCE PROFILES BETWEEN ADJACENT CONTACTS IN HIGH SPEED GRID ARRAY CONNECTORS

(75) Inventors: Alan Raistrick, Rockville, MD (US); Joseph B. Shuey, Camp Hill, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/388,966

(22) Filed: Mar. 14, 2003

(65) Prior Publication Data

US 2004/0180562 A1 Sep. 16, 2004

Related U.S. Application Data

(60) Provisional application No. 60/384,546, filed on May 30, 2002, provisional application No. 60/424,143, filed on Nov. 6, 2002.

(51) Int. Cl.
*H01R 13/42* (2006.01)

(52) U.S. Cl. ..... 439/751; 439/733.1; 439/873

(58) Field of Classification Search ..... 439/751, 439/873, 733.1, 720, 736
See application file for complete search history.

(56) References Cited

U.S. PATENT DOCUMENTS

| | | | | |
|---|---|---|---|---|
| 3,286,220 | A | 11/1966 | Marley et al. | 439/680 |
| 3,538,486 | A | 11/1970 | Shlesinger, Jr. | 439/268 |
| 3,669,054 | A | 6/1972 | Desso et al. | 113/119 |
| 3,704,441 | A | 11/1972 | Douglass | 339/220 T |
| 3,748,633 | A | 7/1973 | Lundergan | 339/217 |
| 4,076,362 | A | 2/1978 | Ichimura | 339/75 |
| 4,159,861 | A | 7/1979 | Anhalt | 339/75 |
| 4,260,212 | A | 4/1981 | Ritchie et al. | 339/97 |
| 4,288,139 | A | 9/1981 | Cobaugh et al. | 339/74 |
| 4,383,724 | A | 5/1983 | Verhoeven | 439/510 |
| 4,402,563 | A | 9/1983 | Sinclair | 339/75 |
| 4,560,222 | A | 12/1985 | Dambach | 339/75 |
| 4,717,360 | A | 1/1988 | Czaja | 439/710 |
| 4,728,164 | A * | 3/1988 | Lemmens et al. | 439/870 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |
| 4,878,861 | A * | 11/1989 | Kendall et al. | 439/751 |
| 4,907,990 | A | 3/1990 | Bertho et al. | 439/851 |
| 4,936,797 | A * | 6/1990 | Wehrle et al. | 439/751 |
| 4,964,814 | A | 10/1990 | Tengler et al. | 439/607 |
| 4,973,271 | A | 11/1990 | Ishizuka et al. | 439/839 |
| 5,066,236 | A | 11/1991 | Broeksteeg | 439/79 |
| 5,077,893 | A | 1/1992 | Mosquera et al. | 29/882 |

(Continued)

FOREIGN PATENT DOCUMENTS

EP 0 273 683 A2 7/1988

(Continued)

*Primary Examiner*—P. Austin Bradley
*Assistant Examiner*—X. Chung-Trans
(74) *Attorney, Agent, or Firm*—Woodcock Washburn LLP

(57) ABSTRACT

An electrical contact that is particularly suitable for use in high speed, grid array connectors is disclosed. The contact includes a retention member extending along a length thereof. The retention member is adapted to retain the contact within a connector base and to deform upon insertion of the contact into the base to cause a generally straight edge to be formed along a portion of the contact that includes the length along which the retention member extends. Thus, a generally uniform impedance profile may be created between adjacent contacts along the respective portions that are inserted into the connector base.

16 Claims, 6 Drawing Sheets

U.S. PATENT DOCUMENTS 5,174,770 A 12/1992 Sasaki et al. ..... 439/108
5,238,414 A 8/1993 Yaegashi et al. ..... 439/108
5,254,012 A 10/1993 Wang ..... 439/263
5,274,918 A 1/1994 Reed ..... 29/882
5,302,135 A 4/1994 Lee ..... 439/263
5,403,215 A 4/1995 Buchter et al. ..... 439/869
5,431,578 A 7/1995 Wayne ..... 439/259
5,475,922 A 12/1995 Tamura et al. ..... 29/881
5,487,684 A * 1/1996 Schalk et al. ..... 439/751
5,558,542 A 9/1996 O'Sullivan et al. ..... 439/682
5,564,954 A 10/1996 Wurster ..... 439/751
5,573,431 A * 11/1996 Wurster ..... 439/751
5,590,463 A 1/1997 Feldman et al. ..... 29/844
5,609,502 A 3/1997 Thumma ..... 439/747
5,645,436 A 7/1997 Shimizu et al. ..... 439/108
5,697,818 A 12/1997 Fukuda ..... 439/751
5,730,609 A 3/1998 Harwath ..... 439/108
5,741,144 A 4/1998 Elco et al. ..... 439/101
5,741,161 A 4/1998 Cahaly et al. ..... 439/709
5,761,050 A * 6/1998 Archer ..... 361/791
5,795,191 A 8/1998 Preputnick et al. ..... 439/608
5,817,973 A 10/1998 Elco et al. ..... 174/32
5,908,333 A 6/1999 Perino et al. ..... 439/631
5,961,355 A 10/1999 Morlion et al. ..... 439/686
5,971,817 A 10/1999 Longueville ..... 439/857
5,980,271 A * 11/1999 MacDougall et al. ..... 439/78
5,980,321 A 11/1999 Cohen et al. ..... 439/608
5,993,259 A 11/1999 Stokoe et al. ..... 439/608
6,050,862 A 4/2000 Ishii ..... 439/843
6,068,520 A 5/2000 Winings et al. ..... 439/676
6,123,554 A 9/2000 Ortega et al. ..... 439/79
6,125,535 A 10/2000 Chiou et al. ..... 29/883
6,139,336 A 10/2000 Olson ..... 439/83
6,146,157 A 11/2000 Lenoir et al. ..... 439/101
6,146,203 A 11/2000 Elco et al. ..... 439/608
6,190,213 B1 2/2001 Reichart et al. ..... 439/736
6,212,755 B1 4/2001 Shimada et al. ..... 29/527.1
6,219,913 B1 4/2001 Uchiyama ..... 29/883
6,220,896 B1 4/2001 Bertoncini et al. ..... 439/608
6,269,539 B1 8/2001 Takahashi et al. ..... 29/883
6,293,827 B1 9/2001 Stokoe et al. ..... 439/608
6,319,075 B1 11/2001 Clark et al. ..... 439/825
6,325,643 B1 12/2001 Ohtsuki et al. ..... 439/82
6,328,602 B1 12/2001 Yamasaki et al. ..... 439/608
6,347,952 B1 2/2002 Hasegawa et al. ..... 439/608
6,350,134 B1 2/2002 Fogg et al. ..... 439/79
6,363,607 B1 4/2002 Chen et al. ..... 29/883
6,371,773 B1 4/2002 Crofoot et al. ..... 439/79
6,379,188 B1 4/2002 Cohen et al. ..... 439/608
6,386,914 B1 5/2002 Collins et al. ..... 439/579
6,409,543 B1 6/2002 Astbury, Jr. et al. ..... 439/608
6,431,914 B1 8/2002 Billman ..... 439/608
6,435,914 B1 8/2002 Billman ..... 439/608
6,454,575 B1 * 9/2002 Jones et al. ..... 439/79
6,454,615 B1 * 9/2002 Yu ..... 439/752.5
6,461,202 B1 10/2002 Kline ..... 439/701
6,471,548 B1 10/2002 Bertoncini et al. ..... 439/608
6,506,081 B1 1/2003 Blanchfield et al. ..... 439/682
6,537,111 B1 3/2003 Brammer et al. ..... 439/857
6,554,647 B1 4/2003 Cohen et al. ..... 439/607
6,572,410 B1 6/2003 Volstorf et al. ..... 439/608
6,652,318 B1 11/2003 Winings et al. ..... 439/608
6,692,272 B1 2/2004 Lemke et al. ..... 439/108
2001/0010979 A1 8/2001 Ortega et al. ..... 439/79
2003/0143894 A1 7/2003 Kline et al. ..... 439/608
2003/0220021 A1 11/2003 Whiteman, Jr. et al. .... 439/608

FOREIGN PATENT DOCUMENTS

JP 06-236788 8/1994
JP 07-114958 5/1995
JP 2000-003743 1/2000
JP 2000-003744 1/2000
JP 2000-003745 1/2000
JP 2000-003746 1/2000
WO WO 01/29931 A1 4/2001
WO WO 01/39332 A1 5/2001

* cited by examiner

MAINTENANCE OF UNIFORM IMPEDANCE PROFILES BETWEEN ADJACENT CONTACTS IN HIGH SPEED GRID ARRAY CONNECTORS

Applicant claims priority to U.S. provisional applications 60/384,546 filed May 30, 2002 and 60/424,143 filed Nov. 6, 2002.

FIELD OF THE INVENTION

This invention relates generally to electrical contacts that are especially suitable for use in high speed, grid array connectors. More particularly, the invention relates to electrical contacts having resilient retention members that retain the contacts within a connector base and provide for a generally uniform impedance profile between adjacent contacts.

BACKGROUND OF THE INVENTION

Typical electrical connectors comprise a connector base made of an insulating material, such as plastic, for example. A plurality of electrical contacts are retained in the connector base. In a so-called "grid array" connector, the contacts are arranged in an array. Such connectors typically include contacts that are retained in the base by virtue of respective retention members that deform the insulating material when the contact is pressed into the base.

FIG. 1 depicts a pair of typical prior art contacts 10 retained in a connector base 14. Each contact 10 has a retention member 12. Retention members 12 as depicted in FIG. 1 are often referred to as "barbs." When a contact 10 is pressed into the connector base 14, the retention member 12 deforms a wall W of the base 14. For example, the retention member 12 may penetrate the material from which the base 14 is formed. Thus, the contact 10 is retained in the base 14.

The impedance, Z, between adjacent contacts 10 is a function of the proximity of the contacts to one another. The use of retention members such as barbs 12, however, tends to create a so-called "impedance discontinuity" in proximity to the barb 12. That is, the impedance $Z_1$ between adjacent contacts 10 as measured in proximity to the barb 12 is significantly different from the nominal impedance $Z_0$ between adjacent contacts 10 as measured elsewhere along the length $L_1$ of the portion of the contact 10 that is in the base 14 (along the x-direction as shown in FIG. 1).

FIG. 2 is a plot of impedance Z between adjacent prior art contacts 10, such as those depicted in FIG. 1. As shown in FIG. 2, a nominal impedance $Z_0$ exists along most of the length L of the portion of the contact 10 that is in the base 14. In proximity to the barb 12, however, the impedance Z between the contacts 10 drops to $Z_1$, where $Z_1<Z_0$. (The magnitude of the impedance discontinuity depicted in FIG. 2 is exaggerated for the purpose of explanation.)

Usually, such an impedance discontinuity is not significant enough to adversely affect the performance of the connector. As connector speeds increase into the range of about 10 Gbps and beyond, however, the discontinuity may adversely affect performance. To compound the problem, the demand for smaller connectors has required connector manufacturers to provide connectors with increasingly greater contact densities. Thus, adjacent contacts are nearer to one another. In such high speed, high density connectors, uniform impedance between adjacent contacts becomes ever more important.

It would be advantageous, therefore, to manufacturers and users of such high speed, high density connectors if there were available electrical contacts that could be adequately retained in the connector base, while maintaining an impedance profile (i.e., impedance between adjacent contacts as measured along the lengths of the portions of the contacts that are in the base) that is generally uniform (i.e., nearly constant) along the lengths of the portions of the contacts that are in the base.

SUMMARY OF THE INVENTION

The invention provides electrical contacts that have a retention member extending along a length of the contact. The contact may include a receptacle end adapted to receive a complementary electrical contact, and an insertion end adapted to be inserted into a connector base.

The retention member is adapted to retain the contact within a connector base and to deform upon insertion of the contact into the base to cause a generally straight edge to be formed along a portion of the contact. The retention member may be adapted to retain the contact within the connector base by creating a normal force between the contact and a wall of the connector base sufficient to retain the contact in the connector base, without deforming the wall of the connector base.

The retention member may include a beam portion that is adapted to deform, upon insertion of the contact into the connector base, to form the generally straight edge along the portion of the contact. The retention member may also include a gap proximate the beam portion that enables the beam portion to deform upon insertion of the contact into the connector base.

The contact may include a deflection member that extends from the beam portion and is adapted to retain the contact within the connector base by creating the normal force between the contact and the wall of the connector base. The deflection member may be adapted to deform the beam portion, upon insertion of the contact into the connector base, to form the generally straight edge along the portion of the contact.

The contact may include a guide member extending along a second portion thereof. The guide member may be adapted to be received into a groove in the connector base. The guide member may have a shoulder via which the contact can be pressed into the connector base. Where the contact is formed by bending a sheet of conductive material, the guide member may be formed from a portion of the sheet that is displaced to form the gap.

BRIEF DESCRIPTION OF THE DRAWINGS

The invention is further described in the accompanying drawings in which.

DETAILED DESCRIPTION OF PREFERRED EMBODIMENTS

Figure 1:
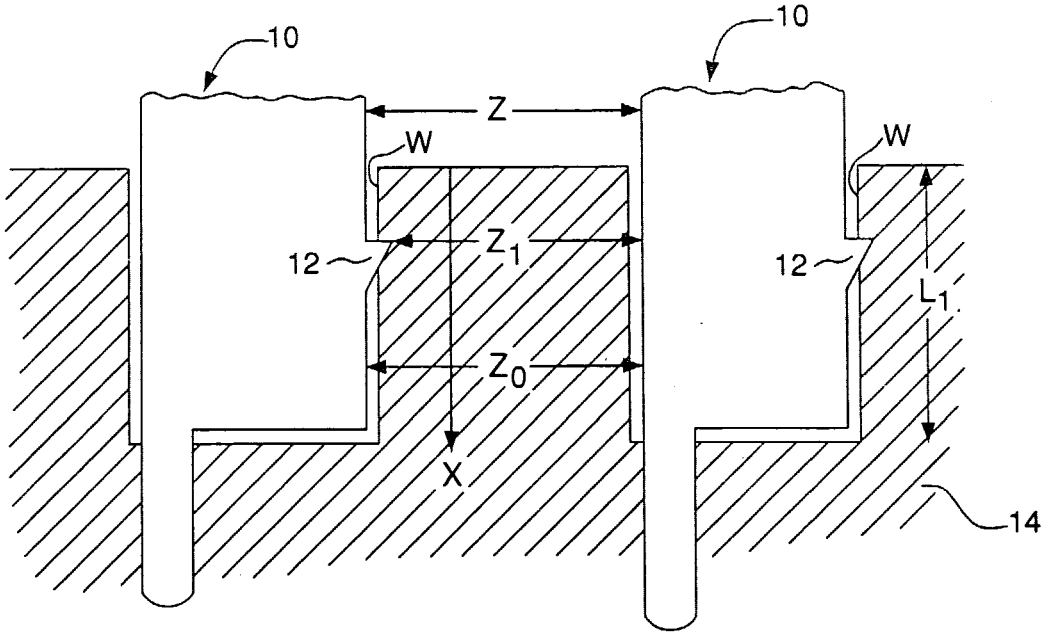
FIG. 1 (PRIOR ART)
FIG. 1 depicts a pair of typical prior art contacts retained in a connector base.
Figure 2:
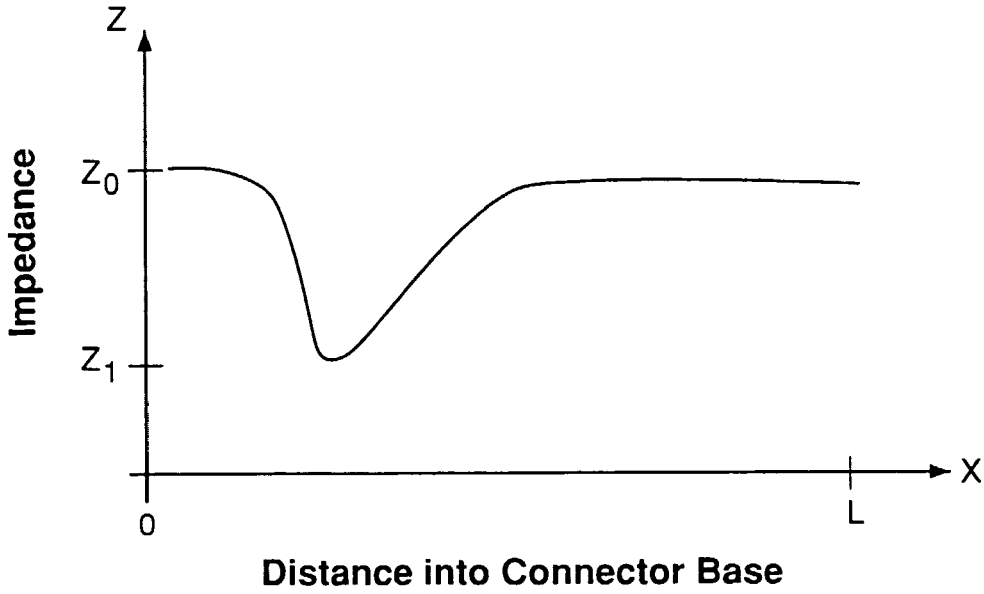
FIG. 2 (PRIOR ART)
FIG. 2 is a plot of impedance between adjacent prior art contacts, such as those depicted in FIG. 1.
Figure 3:
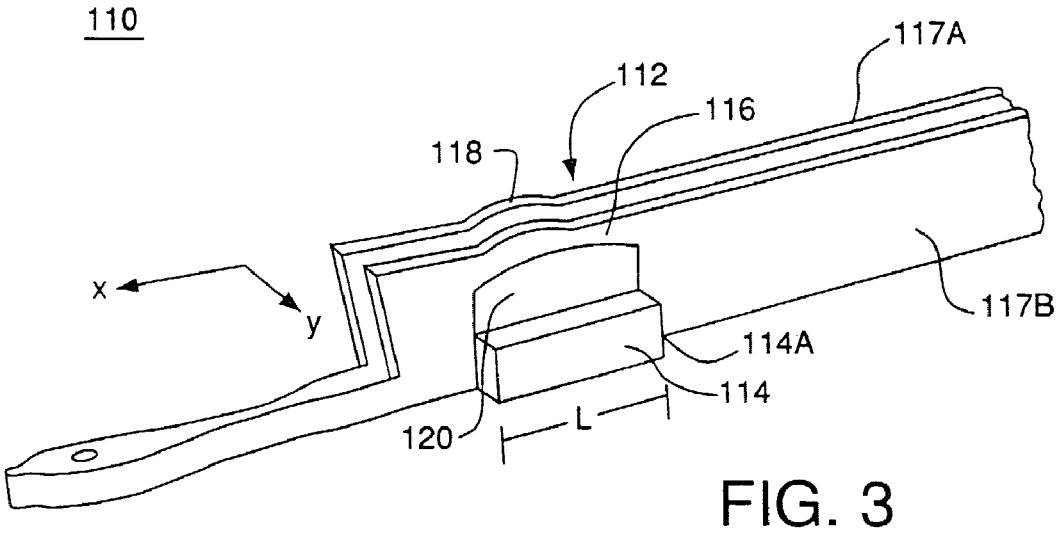
FIG. 3 is a partial perspective view of a preferred embodiment of a contact according to the invention.
Figure 4:
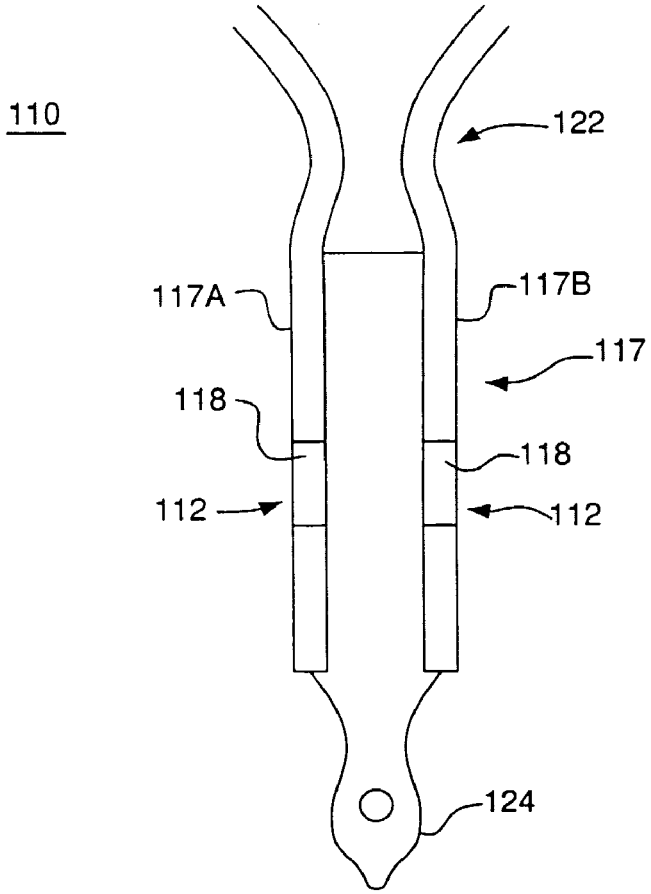
FIG. 4 is a longitudinal view of a preferred embodiment of a contact according to the invention.

FIG. 3 is a partial perspective view, and FIG. 4 is a longitudinal view, of a preferred embodiment of a contact 110 according to the invention. As shown, the contact 110 may include a receptacle portion 122 that is adapted to receive a complementary electrical contact (not shown), an insertion portion 124 that is adapted to be inserted into a connector base (see FIG. 6), and a plate portion 128 connecting the receptacle portion 122 with the insertion portion 124. As shown, the insertion portion 124 can include a compliant "eye in the needle" fit feature. A beam portion of the contact 117 extends between the receptacle portion and the insertion portion. As shown in FIGS. 3 and 4, the beam portion 117 may include two beam members 117A, 117B.

The contact 110 includes a retention member 112 extending at an angle (e.g., generally perpendicular) to the plate portion 128 along a length L of the plate portion 128 between the receptacle portion 122 and the insertion portion 124. The retention member 112 is adapted to retain the contact 110 within the connector base, and to deform upon insertion of the contact 110 into the base to cause a generally straight edge to be formed along the portion of the contact that is inserted into the base. The generally straight edge provides a generally uniform impedance profile between adjacent contacts in the connector. As shown, the contact 110 may include more than one retention member 112, each extending along a respective length of the contact 110.

In a preferred embodiment, the retention member 112 has a resilient beam portion 116 that is adapted to deform, upon insertion of the contact 110 into the connector base, to form the generally straight edge. The contact 110 may include a gap 120 proximate the resilient beam portion 116. The gap 120 allows for resiliency (or "springing action") in the beam portion 116 and thus encourages the beam portion 116 to deform upon insertion of the contact 110 into the connector base. A deflection member 118 may extend from the beam portion 116. The deflection member 118 is adapted to deform the resilient beam portion upon insertion of the contact into the connector base.

The contact 110 may also include a guide member 114 extending along a portion of the contact 110. The guide member 114 provides additional stability to the contact 110 to prevent deformation of the contact 110 upon insertion of the contact 110 into the base 124. Preferably, the guide member 114 is adapted to be received into a groove in the connector base. As shown, the guide member 114 may have a shoulder 114A via which the contact 110 may be pressed into the connector base 124. The shoulder 114A aids in carrying the load of the force required to press the contact 110 into the base 124. In a preferred embodiment, the retention member 112 extends in a first direction along the length of the contact (x-direction as shown in FIG. 3), while the guide member 114 extends in a second direction (y-direction as shown in FIG. 3) that is generally orthogonal to direction in which the retention member extends.

Figure 5:
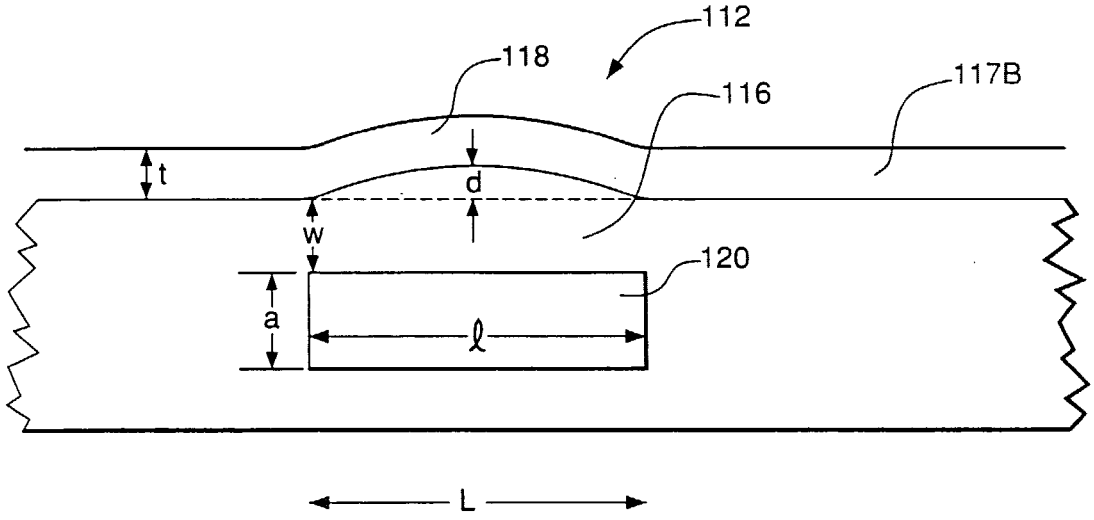
FIG. 5 is a detailed view of a preferred embodiment of a resilient retention member according to the invention.

FIG. 5 is a detailed view of a preferred embodiment of a resilient retention member 112 according to the invention. A typical beam member 117B of the contact 110 has a thickness t. Preferably, as described below in connection with FIG. 10, the contact is stamped from a sheet of electrically conductive material. It should be understood that the thickness of the beam member 117B may be determined by the thickness of the material from which the contact stamped.

The retention member 112 extends along a length L of the beam member 117B. The resilient beam portion 116 of the retention member 112 has a width w. The gap 120 has a gap width a and a gap length l. The deflection member 118 extends a distance d from the beam member 117B.

Though the resilient beam portion 116 and gap 120 can have any shape, it is preferred that the beam portion 116 is bowed somewhat to foster resiliency in the retention member 114. Thus, the beam portion acts like a spring that is "compressed" upon insertion into the connector base 124. The specific geometry of the retention member 114 (e.g., of the resilient beam portion 116 and gap 120) can be determined for a given application (e.g., the desired size and shape of the contact; the proximity of contacts to each other; the materials used to form the contact and connector base).

Figure 6:
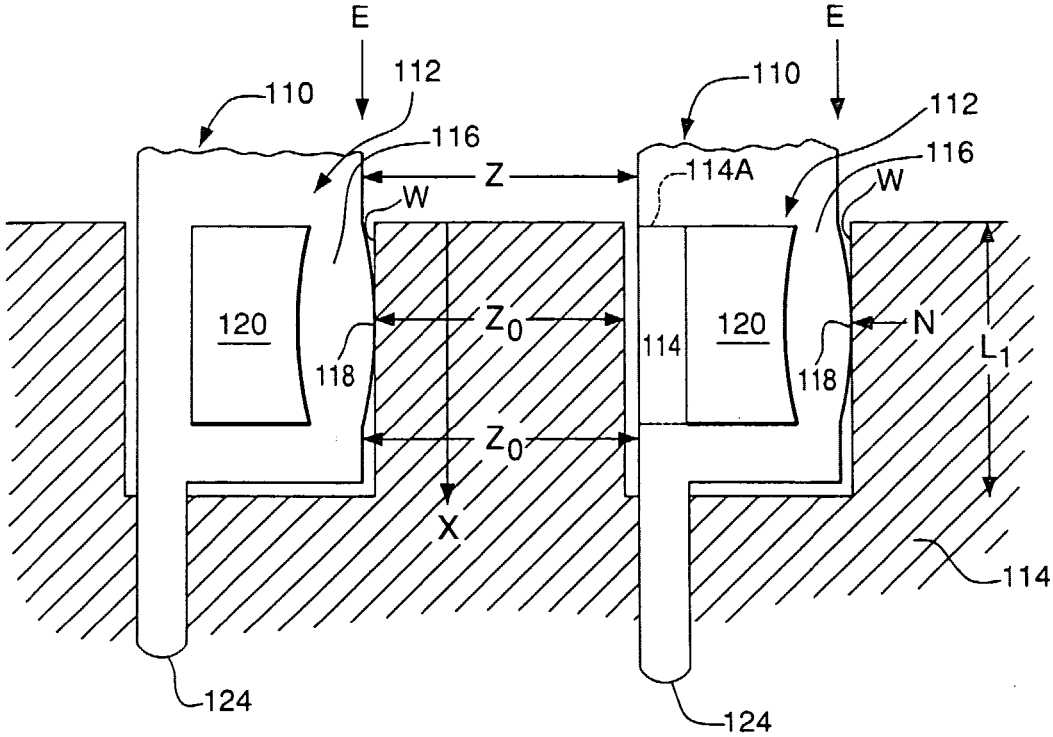
FIG. 6 depicts a pair of contacts according to the invention retained in a connector base.

FIG. 6 depicts a pair of contacts 110 according to the invention retained in a connector base 124. Each contact 110 has a resilient retention member 112. As shown, upon insertion of the contact 110 into the connector base 124, the retention member 112 deforms to cause a generally straight edge E to be formed along the portion of the contact 110 within the connector base 124. The deflection member 118 causes the resilient beam portion 116 to deform while creating a normal force N between the contact 110 and the connector base 124. The normal force N is sufficient to retain the contact 110 in the connector base 124 without significantly deforming the wall W of the connector base 124. Thus, the contact 110 is retained in the connector base 124 and a generally uniform impedance profile is created along the portion of the contact 110 that is within the base 124.

The compressive strength (a.k.a., yield strength) of the material used to form the base should also be considered in determining the geometry of the retention member 114. The connector base 124 can be made of reinforced engineering polymers, for example, the compressive strengths of which are well-known and typically within the range of about 15,000 psi to 25,000 psi. It is anticipated that, in a typical application, a normal force of about 10–15 pounds will ensure that the contact will be retained in the connector base 124.

The pressure the contact exerts on the wall W of the connector base 124 is a function of the surface area of the portion of the retention member 114 that makes contact with the wall W (e.g., the surface area of the deflection member 118) and the normal force N it exerts on the wall W. The surface area of the deflection member 118, for example, can be chosen so that the normal force is sufficient to retain the contact in the base but create pressure below the yield strength of the wall W so as not to deform the wall W (i.e., so that the edge is generally straight and, therefore, the impedance profile is generally uniform). Though the deflection member 118 may, in general, have any shape, it is preferred that the deflection member 118 have a shape that is generally semicircular or generally elliptical. The displacement d of the deflection member 118 (measured from the beam portion 116 to point of contact with wall of the connector base) is expected to be about 5 mil.

Figure 7:
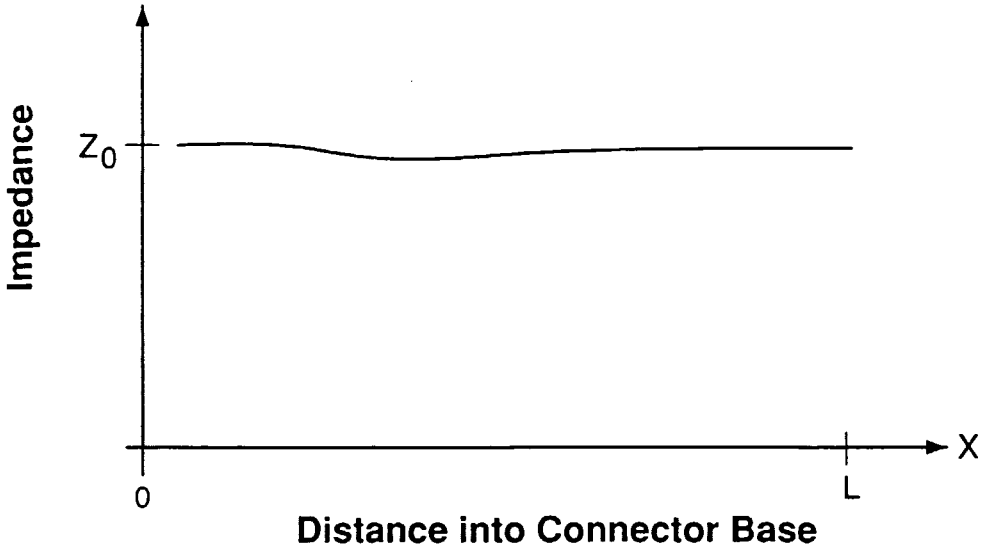
FIG. 7 is a plot of a impedance between adjacent contacts according to the invention, such as those depicted in FIG. 6.

FIG. 7 is a plot of a impedance Z between adjacent contacts according to the invention, such as those depicted in FIG. 6. As shown in FIG. 7, the impedance profile is generally uniform. That is, the impedance Z between adjacent contacts is nearly constant (i.e., $Z_0$) along the length of the portion of the contact that is in the base.

Figure 8A:
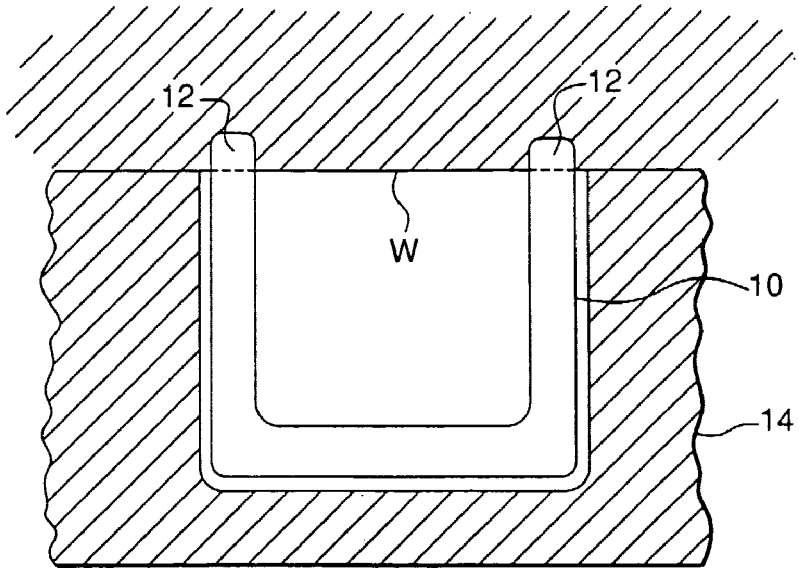
FIG. 8A (PRIOR ART)
FIGS. 8A and 8B provide cross-sectional views of a typical prior art contact and a contact according to the invention, respectively.
Figure 8B:
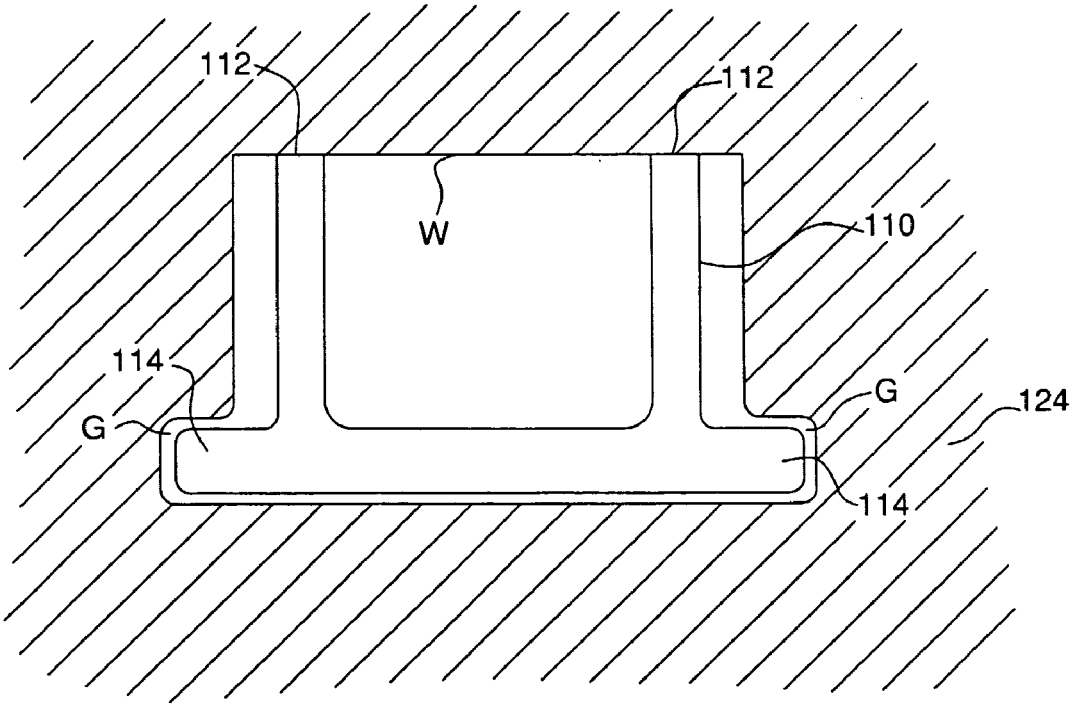

FIGS. 8A and 8B provide cross-sectional views of a typical prior art contact 10 and a contact 110 according to the invention, respectively. As shown in FIG. 8A, a typical prior art contact 10 has a retention member that includes a barb 12. The barb 12 penetrates the wall W of the connector base 14. Thus, an impedance discontinuity is formed between adjacent contacts in the area of the barb 12.

By contrast, a contact 110 according to the invention includes a retention member 112 that deforms upon insertion into the connector base 124 to form a generally straight edge along the portion of the contact 110 that is within the base 124. As shown in FIG. 8B, a contact 110 according to the invention can also include a guide member 114 adapted to be received into a groove G in the connector base 124. The optional guide members 114 may extend from the beam portion of the contact 110 and aid in the insertion of the contact 110 into the base 124.

Figure 9:
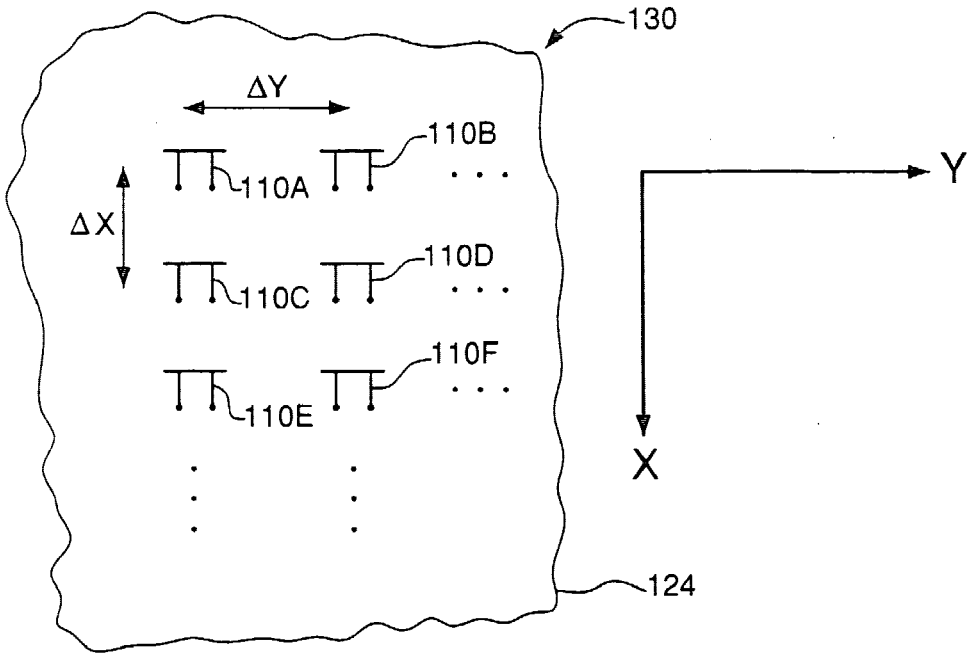
FIG. 9 depicts a connector base having an array of contacts according to the invention retained therein.

FIG. 9 depicts a typical grid array electrical connector 130 having an array of contacts 110*a*–110*e* (generally 110) retained in a connector base 124. Each of the contacts 110 includes one or more retention members extending along respective lengths thereof. Each of the retention members exerts a normal force that retains the respective contact 110 within the connector base 124. Because the retention members deform upon insertion of the contacts 110 into the base 124, each has a generally straight edge along the portions of the contacts that include the lengths along which the retention members extend. Consequently, a generally uniform impedance profile exists between adjacent contacts 110 along the respective portions that are inserted into the connector base 124.

As shown in FIG. 9, the contact array has a row pitch ΔX and a column pitch ΔY. It is expected that, in typical applications, the row pitch ΔX will be larger than the column pitch ΔY. Accordingly, the contacts can be arranged with the deflection members disposed along the columns of the array (i.e., the x-direction as shown in FIG. 9), and the optional guide members disposed along the rows of the array (i.e., the y-direction as shown in FIG. 9).

Preferably, a contact according to the invention may be made by die-cutting and folding a sheet of conductive material. The material may be any suitable electrically conductive material, such as brass, phosphor bronze, or beryllium copper, for example.

Figure 10:
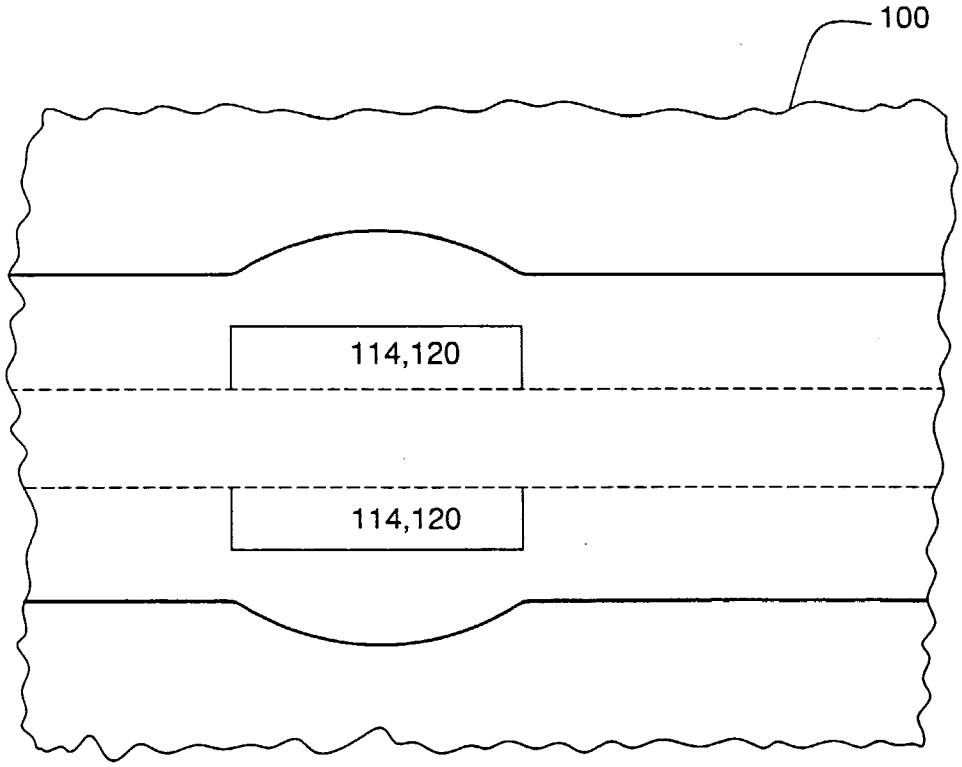
FIG. 10 depicts die-cutting and folding patterns for forming a contact according to the invention.

FIG. 10 depicts cutting and folding patterns for forming a contact according to the invention from a sheet of electrically conductive material 100. The solid lines depict the cutting pattern. The dotted lines depict fold lines. The contact may be cut (by die-cutting with a progressive die, for example) along the solid lines and folded along the dotted lines. Techniques for cutting and folding sheets of electrically conductive material are well-known are, therefore, are not described in detail herein.

As shown in FIG. 10, a guide member 114 may be formed from the portion of the sheet that is displaced during formation of the gap 120. Alternatively, the contact 110 can be made without a guide member by simply stamping a gap in the sheet before folding (i.e., by discarding the portion of the sheet from which the gap 120 is formed).

Though the invention has been described herein in connection with certain currently preferred embodiments shown in the several figures, it should be understood that other similar embodiments may be used or modifications and additions may be made to the described embodiments for practicing the invention without deviating therefrom. Therefore, the invention should not be limited to any particular embodiments, but rather construed in breadth and scope in accordance with the recitation of the appended claims.

We claim:

1. An electrical contact, comprising:

a plate portion; and a retention member extending at an angle to the plate portion along a length of the plate portion, the retention member being adapted to retain the contact within a connector base and comprising a gap that enables the retention member to deform upon insertion of the contact into the base to cause a generally straight edge to be formed along a portion of the contact that includes the length along which the retention member extends.

2. The contact of claim 1, wherein the retention member is adapted to retain the contact within the connector base by creating, between the contact and a wall of the connector base, a normal force sufficient to retain the contact within the connector base.

3. The contact of claim 1, wherein the retention member is adapted to retain the contact within the connector base by creating, between the contact and a wall of the connector base, a normal force sufficient to retain the contact in the connector base without deforming the wall of the connector base.

4. The contact of claim 1, further comprising a guide member extending along a second portion of the contact, the guide member being adapted to be received into a groove in the connector base.

5. The contact of claim 4, wherein the guide member has a shoulder via which the contact can be pressed into the connector base.

6. The contact of claim 4, wherein the retention member extends in a first direction along the length of the plate portion and wherein the guide member extends in a second direction that is generally orthogonal to first direction.

7. The contact of claim 1, further comprising a second retention member extending at an angle to the plate portion along a length of the plate portion, the second retention member being adapted to retain the contact within the connector base and to deform upon insertion of the contact into the base to cause a generally straight edge to be formed along a second portion of the contact that includes the length along which the second retention member extends.

8. An electrical contact, comprising:

a receptacle end adapted to receive a complementary electrical contact, an insertion end adapted to be inserted into a connector base, a plate portion extending between the receptacle end and the insertion end; and a retention member extending at an angle to the plate portion along a length of the plate portion between the receptacle end and the insertion end, the retention member having a resilient beam portion and a deflection member extending from the beam portion, the retention member comprising a gap extending through the retention member, wherein the resilient beam portion deforms into the gap upon insertion of the contact into the connector base to form a generally straight edge along a portion of the contact that includes the length along which the retention member extends.

9. The electrical contact of claim 8, wherein the deflection member is adapted to retain the contact within the connector base by creating a normal force between the contact and a wall of the connector base sufficient to retain the contact in the connector base.

10. The electrical contact of claim 8, wherein the deflection member is adapted to deform the resilient beam portion, upon insertion of the contact into the connector base, to form the generally straight edge along the portion of the contact that includes the length along which the retention member extends.

11. The contact of claim 8, wherein the gap is disposed proximate the resilient beam portion.

12. The contact of claim 11, further comprising a guide member extending along a second portion of the contact, the guide member being adapted to be received into a groove in the connector base.

13. The contact of claim 12, wherein the contact is formed by bending a sheet of conductive material and the guide member is formed from a portion of the sheet that is displaced to form the gap.

14. An electrical connector comprising:

a connector base;

a first electrical contact having a portion thereof inserted into the connector base, the portion comprising a plate portion and a retention member extending at an angle to the plate portion; and a second electrical contact having a portion thereof inserted into the connector base, the second electrical contact being disposed adjacent to the first electrical contact, wherein the retention member comprises a gap extending through the retention member that enables the retention member to deform upon insertion of the first electrical contact into the connector base to cause a generally straight edge to be formed along the portion of the first electrical contact inserted into the connector base such that a generally uniform impedance profile exists between the first and second electrical contacts along the respective portions that are inserted into the connector base.

15. The electrical connector of claim 14, wherein each of the first and second electrical contacts comprises a respective retention member that exerts a respective normal force that retains the respective contact within the connector base.

16. The electrical connector of claim 15, wherein each of the respective retention members has a generally straight edge along a portion of the respective contact that includes the respective length along which the respective retention member extends.

* * * * *

UNITED STATES PATENT AND TRADEMARK OFFICE

CERTIFICATE OF CORRECTION

PATENT NO. : 7,018,246 B2
APPLICATION NO. : 10/388966
DATED : March 28, 2006
INVENTOR(S) : Alan Raistrick and Joseph B. Shuey It is certified that error appears in the above-identified patent and that said Letters Patent is hereby corrected as shown below:

On the title page:

At (60) Related U.S. Application Data (on front page of patent): delete entire paragraph At Col. 1, lines 6-8 (first paragraph beneath the Title): delete entire paragraph Signed and Sealed this Eighteenth Day of March, 2008

JON W. DUDAS
*Director of the United States Patent and Trademark Office*